United States Patent [19]

Barker

[11] Patent Number: 4,532,989

[45] Date of Patent: Aug. 6, 1985

[54] VALVED PLUG FOR PACKER

[75] Inventor: James M. Barker, Carthage, Tex.

[73] Assignee: Otis Engineering Corp., Dallas, Tex.

[21] Appl. No.: 353,394

[22] Filed: Mar. 1, 1982

Related U.S. Application Data

[63] Continuation-in-part of Ser. No. 279,341, Jul. 1, 1981, abandoned.

[51] Int. Cl.[3] ..... E21B 23/06

[52] U.S. Cl. ..... 166/188; 166/133

[58] Field of Search ..... 166/188, 150, 152, 149, 166/153, 155, 133, 114, 143, 334

[56] References Cited

U.S. PATENT DOCUMENTS

| | | | |
|---|---|---|---|
| 2,776,015 | 1/1957 | Bielstein | 166/133 |
| 2,928,469 | 3/1960 | Crowe | 166/188 X |
| 3,011,549 | 12/1981 | Fredd et al. | 166/114 |
| 3,420,305 | 1/1969 | Alexander | 166/133 |
| 3,454,089 | 7/1969 | Brown | 166/133 |
| 3,570,596 | 3/1971 | Young | 166/129 |
| 4,069,865 | 1/1978 | Gazda | 166/152 |
| 4,158,689 | 1/1980 | Harris | 166/188 X |

*Primary Examiner*—William F. Pate, III

*Attorney, Agent, or Firm*—H. Mathews Garland

[57] ABSTRACT

A plug for coupling to the mandrel of a well packer, to convert the packer to a bridge plug, includes an equalizing valve. A fixed component of the plug is an elongated tubular member coupled to the upper end of the packer mandrel and closed at its upper end, and having longitudinally elongated ports in its side walls. The movable component of the plug includes an outer housing for receiving the upper portion of the fixed component and an inner sleeve coupled to the outer housing by means of pins extending through the elongated ports. Seals between the fixed components and the inner sleeve seal the elongated ports in the closed condition of the valve. In the open condition of the valve, ports in the inner sleeve and the outer housing communicate with the elongated ports of the fixed component. The movable component includes a fishing neck attached to the upper end of the outer housing. With this design, the movable component is not affected by differential pressures acting across the bridge plug, and the internal and external elements of the movable component are fully balanced relative to the pressures acting thereon so that there are no resulting forces urging either the opening or the closing of the valve.

28 Claims, 5 Drawing Figures

VALVED PLUG FOR PACKER

This application is a continuation-in-part of application Ser. No. 279,341, filed July 1, 1981 abandoned.

BACKGROUND AND SUMMARY OF THE INVENTION

This invention relates to a plug for a well packer, for converting the packer to a bridge plug; and more particularly to such plug which incorporates an equalizing valve.

One object of this invention is to provide a novel equalizing plug for use with a well packer, to convert the packer to a bridge plug.

Another object of this invention is to provide such a plug having an equalizing valve which is resettable between open and closed positions through a number of cycles without removal from the well.

Still another object of this invention is to provide such a plug having an equalizing valve which can be locked in either the valve closed or valve open position.

A further object of this invention is to provide such plug for use with a well packer which can be set, released and reset repeatedly in various locations within the well bore, with the valved plug performing repeated plugging and equalizing functions as required.

Still another object of this invention is to provide a novel packer and plug combination to produce a bridge plug which can be set, released and reset repeatedly in various locations within the well bore.

A still further object of this invention is to provide a valved plug for use with a well packer to provide an equalizing function as required, wherein the plug valve is fully pressure balanced relative to the pressures acting thereon.

Another object of this invention is to provide a novel packer and plug combination which produces a resettable bridge plug with a fully pressure balanced equalizing valve.

A further object of this invention is to provide a novel packer and valved plug combination wherein the packer is set by setting down weight on the packer mandrel, and wherein that same set down weight effects the closing of the valved plug; and wherein the pickup of the packer mandrel to release the packer, first opens the plug equalizing valve.

These objects are attained in a valved plug for coupling to the mandrel of a well packer which comprises a fixed component and a component movable relative to the fixed component between valve open and valve closed positions. The fixed component is an elongated tubular member closed at its upper end, and having means at its lower end for coupling to a packer mandrel in sealing relation. The movable component includes an outer member, which defines a lower tubular housing for receiving the upper end of the fixed component, and an elongated inner tubular member. The inner tubular member is disposed within the fixed component; and means is provided for coupling the inner tubular member to the outer housing for longitudinal movement therewith relative to the fixed component. The fixed component and the movable component have lateral ports disposed to be communicated with each other in the valve open position of the movable component; and seal means are provided effective between the fixed component and the inner tubular member of the movable component, in the valve closed position of the movable component, to close the ports of the fixed component.

These objects are also attained in that valved plug in combination with a well packer having a mandrel which defines the packer bore, and having seal means for engaging the well bore to seal the annulus between the bore and the mandrel; that combination providing a bridge plug for a well.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
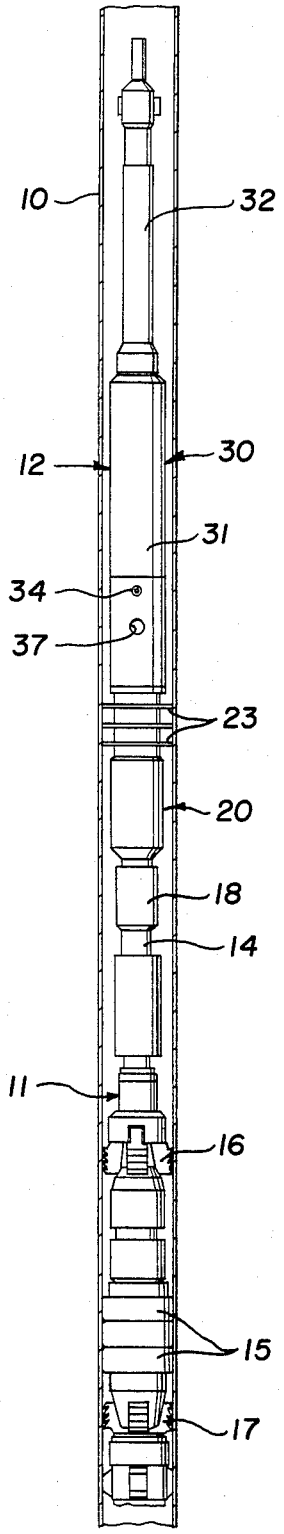
FIG. 1 is a diagrammatic view of a packer and valved plug combination according to the invention.

FIG. 1 of the drawing is a diagrammatic view illustrating the combination of a casing packer 11 and valved plug 12 anchored within a well casing 10. The plug 12, according to the invention, is particularly suited for use with a resettable casing packer; and one example of such a resettable casing packer is the Otis Perma-Lach casing packer manufactured by Otis Manufacturing Corporation of Dallas, Tex. That packer is described in detail in U.S. Pat. No. 3,570,596 issued Mar. 16, 1971 entitled "Well Packer and Hold Down Means". That packer, as illustrated somewhat diagrammatically in FIG. 1, includes a mandrel 14, defining the packer bore, and elastomeric packing rings 15, upper slips 16 and lower slips 17 for engagement with the wall of the casing. The packing rings and slips are carried on suitable carriers mounted on the mandrel. The plug 12 is attached directly to the upper end of the packer mandrel 14 by means of a threaded connection such as a coupling 18.

The valved plug 12, as seen in FIG. 1, consists basically of a fixed component 20, which is the component attached to the packer mandrel, and a movable component 30 which is movable relative to the fixed component to perform the valving function of the plug. The fixed component carries wiper fins 23 in wiping engagement with the casing wall to prevent solid material which may be packed above these fins from passing downward to possibly interfere with the packer operation. The movable component of the plug includes an outer housing portion 31, defining a chamber closed at its upper end, and an upper fishing neck 32 for coupling with a handling tool for manipulating the valved plug and the packer to which it is attached.

Figure 2A:
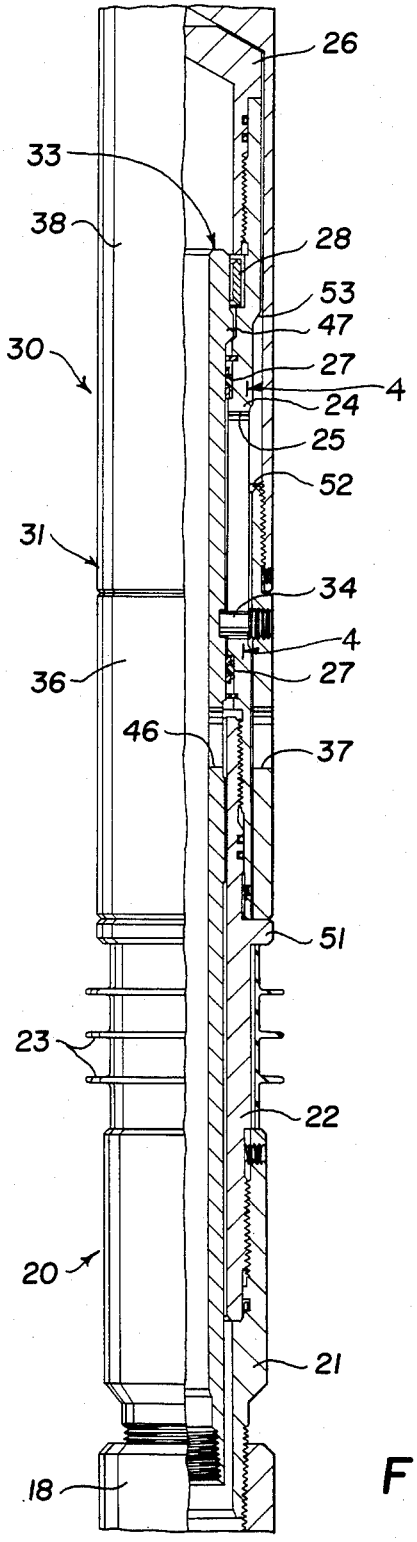
FIGS. 2A and 2B are sequential elevation and sectional views of the valved plug assembly, in the valve closed condition.
Figure 2B:
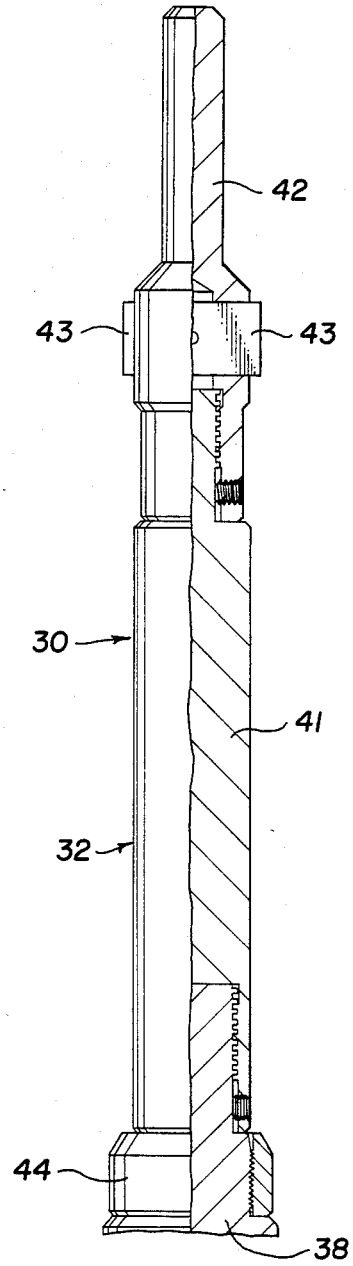
Figure 3:
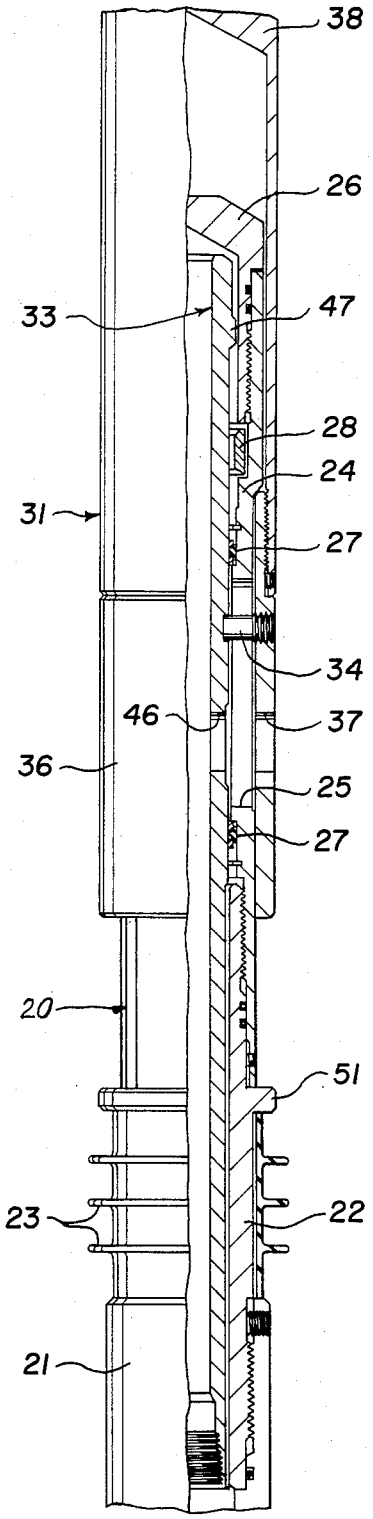
FIG. 3 is a view similar to FIG. 2A showing that portion of the assembly in the valve open condition.

FIGS. 2A and 2B illustrate the structure of the valved plug 12 in detail, with the valve in the closed condition; and FIG. 3 illustrates portions of the valved plug in the valve open condition. Referring to these figures, it will be seen that the movable component 30 includes an inner mandrel 33, in addition to the above mentioned outer housing 31 and fishing neck 32. The outer housing and inner mandrel are coupled by a pair of pins 34 threaded into the outer housing and seated in flat bottom holes in the inner mandrel, so that the inner mandrel moves both longitudinally and rotationally with the outer housing.

Referring now to the fixed component 20, this component comprises an elongated tubular member closed at its upper end, and therefore defining a closed chamber open at its lower end for communication with the packer bore. This fixed component is made up of a bottom sub 21, a wiper fin mandrel 22 carrying the above mentioned wiper fins 23, a slotted mandrel 24 provided with opposed elongated slots 25, and a cap 26. The lower end of the bottom sub is provided with a threaded pin for threaded attachment to the packer through the coupling 18. The elongated slots 25 provide openings in the wall of the fixed component to pass the above mentioned pins 34, and accommodate the relative longitudinal movement of the movable component relative to the fixed component, and also provide fluid ports for the valving function. A pair of annular seals 27 are mounted on the inner wall of the fixed component, adjacent to the upper and lower ends of the slots 25 and are confined against axial movement. These seals coact with the outer wall of the inner mandrel 33 to close the ports 25, in the valve closed condition illustrated in FIG. 2A. A latching snap ring 28, axially confined on the inner wall of the fixed component, above the ports 25, coacts with the inner mandrel as will be described. The wiper fins 23 may consist of a rubber sleeve bonded to a metal sleeve, the rubber sleeve including integral axially spaced, annular ribs for engagement with the casing wall.

Referring again to the movable component 30, the outer housing portion 31 is made up of a lower housing 36 having opposed ports 37 and an upper housing 38 which is closed at its upper end; these parts defining a tubular housing and closed chamber for receiving a portion of the fixed component 20.

The fishing neck 32 includes an elongated stem 41 attached to an upper projection of the upper housing 38, and a top sub 42. A rectangular member secured within a transverse slot in the top sub, projects laterally to define opposed lifting lugs 43 to be engaged by a complementary handling tool to effect the lifting of the valved plug 12. A bearing ring 44 threaded onto the upper housing below the stem 41 functions as a bearing shoulder for engagement by the handling tool to effect downward force upon the valved plug 12 and elements attached thereto. The handling tool may be, for example, an overshot which performs the functions of both a running tool and a pulling tool.

The inner mandrel 33 of the movable component is essentially a tubular sleeve having opposed ports 46 which are laterally aligned with the ports 37 of the outer housing, and having an external annular detent 47 adjacent to its upper end for coaction with the latching snap ring 28 as will be described. The lower end of this inner mandrel is provided with a threaded box for the attachment of any desired tool or element.

OPERATION

In the valve closed condition, illustrated in FIG. 2A, the movable component is in a lower limiting position relative to the fixed component, which position is defined by the engagement of the lower end face of the outer housing 31 with a shoulder defined by a flange 51 on the wiper fin mandrel 22. In this condition the annular detent 47 is disposed just below the latching snap ring 28; and the coaction of these parts presents a yieldable resistance to movement of the movable component out of the valve closed condition. The fixed member ports 25 are closed by the two annular seals 27 so that the annulus between the valved plug 12 and the casing 10 is sealed with respect to the chamber within the fixed component and the packer bore.

An important aspect of this valved plug design is that the valve is completely pressure balanced, in this closed condition, with respect to the pressures extant both within the chamber of the fixed component and in the annulus surrounding the plug 12. The internal pressure, which is the pressure of the well below the packer 11, acts on equal effective upper and lower piston areas of the inner mandrel 33, so that the movable member is not urged in either direction relative to the fixed component. The pressure exerted by any fluid in the annulus has access to the interior chamber of the outer housing 31, through the ports 37 and the clearance space between the outer housing and the fixed component, so that again the effective downward facing and upward facing piston areas of the combined outer housing and fishing neck are the same and this assembly is not urged in either direction. The inner mandrel is isolated from the external pressure by the seals 27; likewise, the assembly of the outer housing 31 and the fishing neck 32 is isolated from the internal pressure by the seals 27. As a result of the described sealing arrangement, any differential pressure across the bridge plug assembly cannot act to shift the movable component to the valve open position. Accordingly there are no forces, resulting from the extant pressures, to cause inadvertent shifting of the movable component to the valve open condition. The coaction of the latching snap ring 28 and the detent 47 provides a yieldable resistance to maintain the plug in the valve closed condition as the handling tool is removed from the fishing neck. This yieldable resistance to opening the valve assures that the valve will only be opened when intended.

The valve is shifted to the valve open condition by lifting on the fishing neck 32 with a handling tool, and moving the movable component to an upper limit position defined by engagement of a shoulder 52, at the upper end of the lower housing 36, with an external downward facing shoulder 53 on the slotted mandrel 24 of the fixed component. This movement moves the ports 46 of the inner mandrel upward past the lower seal ring 27 to place the ports 46, 25 and 37 in communication and permit the internal and external pressures to equalize. During the opening process, the restraining force presented by the snap ring 28 and detent 47 must be overcome by sufficient upward pull on the lifting lug 43.

With the combination of packer and plug, several successive operations of setting weight down on the packer mandrel and pulling up on the packer mandrel, perhaps coupled with rotation, may be required to release the packer from the casing for subsequent placement within the well or for removal from the well. These operations on the packer mandrel are, of course, accomplished through the fishing neck of the plug 12. The first operation is an upward pull on the fishing neck to open the valve and permit pressure equalization to minimize any adverse effect of differential pressure acting across the packer when it is released from the casing. The valved plug is designed to accomodate these several opening and closing operations which necessarily occur during the operations to effect both the release of the packer from the casing and also the resetting of the packer.

In the valve open condition of the plug 12, the detent 47 is disposed above the snap ring 28, and the snap ring functions as a restraint to return of the valve to the valve closed condition. In the valve open condition, the valve is again pressure balanced with respect to the common pressure now acting both internally and externally, and there is no urging of the valve to the closed condition. The restraint presented by the snap ring 28 requires a downward force on the movable member to effect the return of the valve to the closed condition. Where downward movement of the packer mandrel 14 is a function of the setting of the packer within the casing, the operation of the valved plug is complementary since the same downward movement will effect the shifting of the valve to the valve closed condition.

It should be noted that the valved plug 12 may be shifted between the valve open and valve closed conditions numerous times while the plug is within the hole and without the necessity for redressing. This valved plug then is particularly well suited for use with a resettable packer and which may be set and released at various locations within the well casing, again without necessity of removal from the well for redressing. The above mentioned Otis Perma-Lach packer is designed to perform in that manner.

Figure 4:
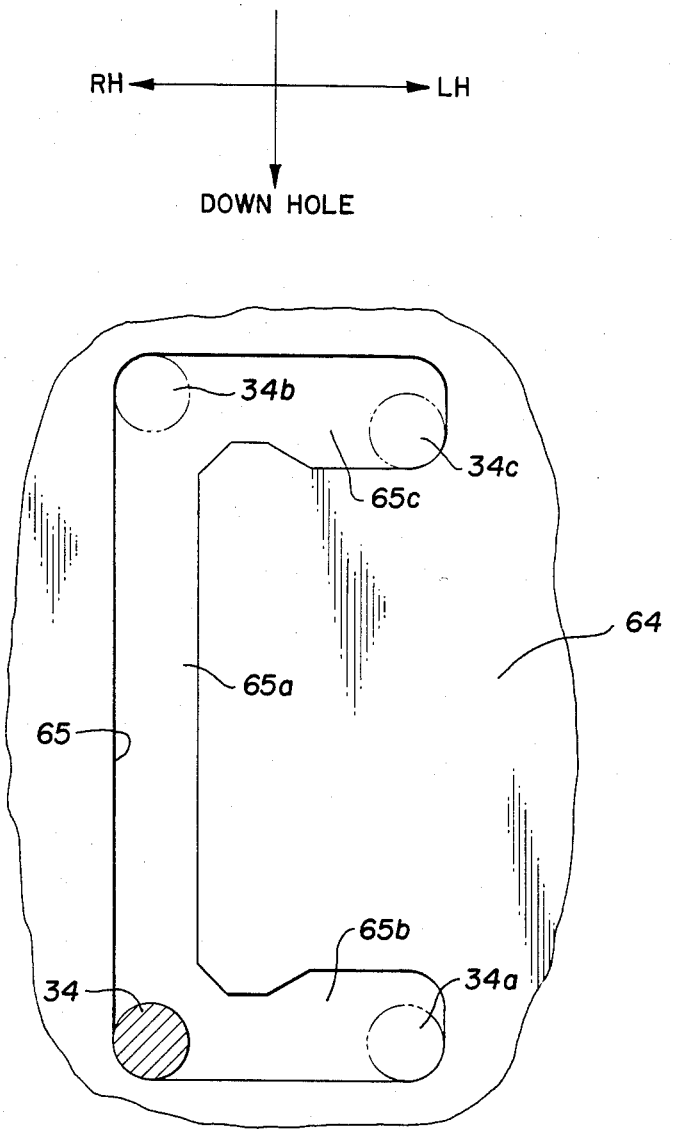
FIG. 4 is a fragmentary view taken along the line 4—4 of FIG. 2A.

Embodiment of FIG. 4

FIG. 4 is a fragmentary view showing an alternative form of slotted mandrel 64 for the fixed component 20, which slotted mandrel is provided with two opposing C-shaped slots 65 for coaction within the coupling pins 34 threadedly mounted in the lower housing 36 of the movable component. These C-shaped slots 65 include a vertical leg 65*a* which corresponds, both in location and function, to the above mentioned vertical slots 25. The slots 65 further include lower lateral legs 65*b* and upper lateral legs 65*c*, provided for locking the valved plug in either the closed condition or the opened condition as will be described.

The illustrated C-shaped configuration of the slots 65 is provided for the most efficient operation of the locking functions, when the valved plug 12 is used with the Perma-Lach packer which has been referred to. It may be that for use with a different packer, a different slot configuration may be most appropriate, such as a Z-shaped configuration.

The pins 34 are associated with the movable component 30; and the direction of rotation of the movable component and the pins 34 are indicated by the arrows in FIG. 4. In FIG. 4, the pin 34 is shown in the lower corner of the C-shaped slot 65 which corresponds to the condition of the valved plug in FIG. 2 which is the closed condition. It will be seen then that left hand (LH) rotation of the movable component, about one-quarter turn for example, will move the pin 34 in the slot to the position 34*a;* and in this position the valved plug will remain locked in the valve closed position against subsequent upward movement of the movable member, so long as right hand (RH) rotation does not occur.

Should it be desired to shift the valve of the valved plug from the valve closed to the valve open condition, the movable component must first be rotated right hand to position the pin in the solid line position, then the movable component raised to position the pin at position 34*b*. The movable component may then be rotated left hand to move the pin to lock position 34*c*. In position 34*c* the valved plug will remain in the valve open condition against subsequent downward movement of the movable component, so long as right hand rotation does not occur.

Relating now the operation of this modified form of valved plug to the operation of the Perma-Lach packer, when the assembly of packer and valved plug is run into the well by means of a tubing string to the desired position, the packer is set first by right hand rotation to release a lower latch and then by setting down weight on the packer to effect the setting of the slips 16 and 17, the expansion of the seals 15, and the latching of an upper latch to maintain the packer in set condition. That right hand rotation to effect the setting of the packer would assure that the pins 34 move to the vertical legs 65*a* of the slots 65, and the subsequent setting down weight would move the pins to the solid line position at the lower corner of the slots 65 to close the valve. A subsequent quarter turn left hand rotation imparted to the movable component 30 will then move the pins to the lock positions 34*a* to lock the plug in the valve closed position; and this same left hand rotation may effect the release of the handling tool from the fishing neck 32. The packer and valved plug are then set in place in the valve closed condition.

If it is desired to shift the valve to the open condition without disturbing the packer, this is accomplished by engaging a handling tool with the fishing neck 32 effecting a quarter turn of right hand rotation to move the pins out of the lower slot legs 65*b*, lifting of the movable component to open the valve, and subsequent quarter turn left hand rotation to move the pin to lock position 34*c* to lock the valve in the open condition.

For unsetting the packer, either to remove the packer from the well or to shift the packer and plug assembly to a different location within the well, the running tool is first engaged with the fishing neck. Assuming that the plug is in the valve closed condition, right hand rotation and subsequent raising of the movable component is accomplished to unlock the valve and to shift to the valve open condition for pressure equalization. For unsetting the Perma-Lach packer, additional slight right hand rotation is required to release the upper latch of the packer followed by lifting of the packer mandrel to release the slips and the seals, and to automatically reset the lower latch which conditions the packer for running within the well. With these movements the valved plug will likely remain in the valve open condition; however the condition of the valve during movement of the packer in the well is usually immaterial, since the packer provides its own bypass in this condition to facilitate running through fluid in the well.

What has been described is a unique valved plug for use in combination with a well packer, to convert that packer to a bridge plug. The valved plug incorporates an equalizing valve to enable equalizing of the pressures across the resulting bridge plug, before releasing the bridge plug from the well bore.

A particular feature of the valved plug is that it is well adapted for use with a casing packer which is not only retrievable, but which is resettable within the casing, and may be set and unset a number of times before it becomes necessary to retrieve the packer for redressing. The valved plug is complementary to such a packer in that the incorporated equalizing valve may be opened and closed through a number of cycles, to perform its plugging and equalizing function, without the necessity for removal from the well for redressing.

An important feature of the valved plug is that it is fully balanced with respect to the pressures acting thereon both in the valve closed and valve open positions. The design is such that the differential pressure acting on the bridge plug, in the valve closed and plugging condition, cannot act to inadvertently open the valve, nor is there any imbalance of forces acting on the valve part exposed to either the pressure below the bridge plug or the pressure above the bridge plug tending to open the valve. Similarly, in the valve open condition, there is no imbalance of forces resulting from the then equalized pressures across the valve, which would tend to inadvertently close the valve.

An additional feature of the valved plug is the provision of means for maintaining the plug locked in either the valve closed or the valve open condition, such that forces tending to move the movable component of the valved plug vertically will not inadvertently shift the valve to the opposite condition.

While the preferred embodiment of the invention has been illustrated and described, it will be understood by those skilled in the art that changes and modifications may be resorted to without departing from the spirit and scope of the invention.

What is claimed is:

1. A valved plug for coupling to the mandrel of a well packer comprising a fixed component, and a component movable axially relative to said fixed component between valve closed and valve open conditions;

said fixed component comprising an elongated tubular member closed at its upper end, having means at its lower end for coupling to a packer mandrel in sealing relation;

said movable component comprising an elongated outer member including a tubular housing closed at its upper end, enclosing the upper portion of said fixed component, and an elongated inner tubular member disposed within said fixed component;

said fixed component and said movable component having lateral port means disposed to be communicated with each other in the valve open condition of said movable component, and to be sealed from each other in the valve closed condition of said movable component; and means coupling said elongated outer member with said elongated inner member forming said movable component into integral valve structure movable relative to said fixed component between said valve open and said valve closed conditions.

2. A plug as set forth in claim 1 said inner member of said movable component having substantially equal, axially opposed, effective piston areas exposed to the fluid within said fixed component.

3. A plug as set forth in claim 1 said outer member of said movable component having substantially equal, axially opposed, effective piston areas exposed to the fluid surrounding said plug.

4. A plug as set forth in claim 1 said outer member of said movable component including fishing neck means for latching engagement by a handling tool.

5. A plug as set forth in claim 1 said port means of said fixed component comprising peripherally spaced, longitudinally elongated slots; said coupling means comprises pin means extending through said slots, coupling said outer member and said inner member of said movable component.

6. A plug as set forth in claim 5 said coupling pin means coupling said outer member and said inner member both longitudinally and rotationally.

7. A plug as set forth in claim 1 said seal means comprising annular seals mounted on said fixed component, above and below its lateral port means, for sealing engagement with the outer surface of said inner member.

8. A plug as set forth in claim 1 restraining latch means including coacting elements mounted on said fixed component and said movable component, operative to retain said movable component in the valve closed condition.

9. A plug as set forth in claim 1 restraining latch means including coacting elements mounted on said fixed component and said movable component, operative to retain said movable component in the valve open position.

10. A plug as set forth in claim 1 annular wiper fins mounted on said plug for engagement with the wall of the well casing.

11. A plug as set forth in claim 1 seal means disposed in sealing relation between said fixed component and said inner member of said movable component, effective to seal off said port means in the valve closed condition.

12. A plug as set forth in claim 1 locking means for locking said valve plug in the valve closed condition comprising one of said fixed or movable components having a laterally projecting locking lug;

the other of said fixed or movable components having an L-shaped slot to receive said locking lug; said slot including a longitudinal leg, to accommodate the relative axial movements of said components between valve open and valve closed conditions, and a lateral leg communicating with one end of said longitudinal leg to accommodate relative rotation of said components in the valve closed condition.

13. A plug as set forth in claim 1 locking means for locking said valved plug in a selected valve open or valve closed condition, comprising one of said fixed or movable components having a laterally projecting locking lug;

the other of said fixed or movable components having a coacting labyrinthine slot to receive said locking lug; said slot including a longitudinal leg to accommodate the relative axial movements of said components between valve open and valve closed conditions, and lateral legs communicating with said longitudinal leg at each end thereof to accommodate relative rotation of said components in both the valve open- and valve-closed conditions.

14. A plug as set forth in claim 12 said lateral leg of said slot being disposed to accommodate rotation of said movable component to the locked condition, in the same direction of rotation required to release a handling tool from a fishing neck of said movable member.

15. A bridge plug for a well comprising in combination a well packer having a mandrel defining the packer bore, and means for engaging the wall of the well bore and for sealing the annulus between said well bore and said mandrel;

a valved plug coupled to said packer mandrel to close selectively said packer bore; said plug comprising a fixed component for coupling to said mandrel, and a component movable axially relative to said fixed component between valve closed and valve open conditions;

said fixed component comprising an elongated tubular member closed at its upper end, having means at its lower end for coupling to said packer mandrel in sealing relation;

said movable component comprising an elongated outer member including a tubular housing closed at its upper end enclosing the upper portion of said fixed component, and an elongated inner tubular member disposed within said fixed component;

said fixed component and said movable component having lateral port means disposed to be communicated with each other in the valve open condition, and to be sealed from each other in the valve closed condition; and means coupling said elongated outer member with said elongated inner member forming said movable component into integral valve structure movable relative to said fixed component between said valve open and said valve closed conditions.

16. A bridge plug as set forth in claim 11 seal means disposed in sealing relation between said fixed component and said inner member of said movable component, effective to seal off said port means in the valve closed condition.

17. A bridge plug as set forth in claim 15 said inner member of said movable component having substantially equal, axially opposed, effective piston areas exposed to the fluid within said fixed component.

18. A bridge plug as set forth in claim 15 said outer member of said movable component having substantially equal, axially opposed, effective piston areas exposed to the fluid surrounding said plug.

19. A bridge plug as set forth in claim 15 said outer member of said movable component including fishing neck means for latching engagement by a handling tool.

20. A bridge plug as set forth in claim 15 said port means of said fixed component comprising peripherally spaced, longitudinally elongated slots; said coupling means comprising pin means extending through said slots, coupling said outer member and said inner member of said movable component.

21. A bridge plug as set forth in claim 20 said coupling pin means coupling said outer member and said inner member both longitudinally and rotationally.

22. A bridge plug as set forth in claim 15 said seal means comprising annular seals mounted on said fixed component, above and below its lateral port means, for sealing engagement with the outer surface of said inner member.

23. A bridge plug as set forth in claim 15 restraining latch means including coacting elements mounted on said fixed component and said movable component, operative to retain said movable component in the valve closed condition.

24. A bridge plug as set forth in claim 15 restraining latch means including coacting elements mounted on said fixed component and said movable component, operative to retain said movable component in the valve open condition.

25. A bridge plug as set forth in claim 15 annular wiper fins mounted on said plug for engagement with the wall of the well casing.

26. A bridge plug as set forth in claim 15 locking means for locking said valve plug in the valve-closed condition comprising one of said fixed or movable components having a laterally projecting locking lug;

the other of said fixed or movable components having an L-shaped slot to receive said locking lug; said slot including a longitudinal leg, to accommodate the relative axial movements of said components between valve open and valve closed conditions, and a lateral leg communicating with one end of said longitudinal branch, to accommodate relative rotation of said components in the valve closed condition.

27. A bridge plug as set forth in claim 15 locking means for locking said valved plug in a selected valve open or valve closed condition, comprising one of said fixed or movable components having a laterally projecting locking lug;

the other of said fixed or movable components having a coacting labyrinthine slot to receive said locking lug; said slot including a longitudinal leg to accommodate the relative axial movements of said components between valve open and valve closed conditions, and lateral legs communicating with said longitudinal leg at each end thereof to accommodate relative rotation of said components in both the valve open and valve closed conditions.

28. A bridge plug as set forth in claim 26 said lateral leg of said slot being disposed to accommodate rotation of said movable component to the locked condition, in the same direction of rotation required to release a handling tool from a fishing neck of said movable member.

* * * * *